US005649636A

United States Patent [19]

Baumann

[11] Patent Number: 5,649,636

[45] Date of Patent: Jul. 22, 1997

[54] ADJUSTABLE LOAD LIFTING DEVICE

[75] Inventor: James A. Baumann, Orland Park, Ill.

[73] Assignee: MI-Jack Products Inc., Hazel Crest, Ill.

[21] Appl. No.: 598,367

[22] Filed: Feb. 8, 1996

[51] Int. Cl.[6] ..... B66C 1/10

[52] U.S. Cl. ..... 212/344; 212/276; 212/326; 294/81.2; 294/907

[58] Field of Search ..... 294/907, 81.41, 294/81.53, 81.51, 81.56, 81.1, 81.2; 212/344, 275, 276, 326, 327

[56] References Cited

U.S. PATENT DOCUMENTS

| | | | |
|---|---|---|---|
| 2,718,320 | 9/1955 | Nelson et al. | 294/907 |
| 4,139,107 | 2/1979 | Ninomiya et al. | 294/907 |
| 4,244,615 | 1/1981 | Brown | 294/81.1 |
| 4,396,218 | 8/1983 | Stevens | 294/81.41 |
| 4,546,891 | 10/1985 | Lanigan, Sr. et al. . | |
| 4,667,834 | 5/1987 | Lanigan et al. . | |
| 4,715,762 | 12/1987 | Lanigan, Sr. et al. . | |
| 5,183,305 | 2/1993 | Nordstrom et al. | 294/81.2 |
| 5,354,112 | 10/1994 | Hara et al. | 294/81.2 |
| 5,415,517 | 5/1995 | Lanigan, Sr. et al. . | |

FOREIGN PATENT DOCUMENTS

| | | | |
|---|---|---|---|
| 440915 | 8/1991 | European Pat. Off. | 294/907 |
| 3621648 | of 0000 | Germany | 294/81.53 |

*Primary Examiner*—Thomas J. Brahan
*Attorney, Agent, or Firm*—Gerstman, Ellis & McMillin, Ltd.

[57] ABSTRACT

An adjustable system for lifting and transferring load containers which comprises a frame, a container lifting device, and a cable attached to the frame and lifting device. A first actuator is provided for raising and lowering the lifting device, which lifting device has a plurality of remotely controllable latches for engaging and disengaging latchable portions of the containers, to permit grasping and lifting of containers by the lifting device. New features of adjustability are provided, to permit the system to lift containers of varying sizes. Also, the lifting device preferably carries an electrically operated location sensing device for sensing and signalling to the operator a proper location of the latches relative to the latchable portions, to permit such latching.

18 Claims, 5 Drawing Sheets

ADJUSTABLE LOAD LIFTING DEVICE

BACKGROUND OF THE INVENTION

Grappler systems for the picking up and transferring of loads are disclosed, for example, in Lanigan et al. U.S. Pat. Nos. 4,546,891; 4,667,834; 4,715,762; and 5,415,517, among others.

These devices are particularly adapted to pick up and move containers such as large metal shipping or load containers and even truck trailers (which are included in the term "containers"). Also, the devices of the previous patents include grapplers which are capable of gripping and lifting more than one container in a stack, to transfer several containers at once.

By this invention, systems for lifting and transferring load containers are improved, in that they can vary the dimensions of the distribution of the lifting latches carried by the system, so that containers of differing sizes may be lifted and moved. Also, a system is provided for facilitating alignment of the lifting latches with apertures on the load containers, so that the load containers may be reliably, easily, and safely gripped for lifting without the need for close-up visual adjustment. Rather, the operator in the cab of the system can quickly and effectively make such latching contact with various sizes of containers.

Also, the system of this invention may be folded up for travel into a relatively compact unit, permitting easier shipping and the like.

DESCRIPTION OF THE INVENTION

By this invention, a system is provided for lifting and transferring load containers. The system comprises a frame, a container lifting device or spreader, a cable or chain attached to the frame and lifting device, and a first actuator, typically an electric motor, for raising and lowering the lifting device. The lifting device has a plurality of remotely controllable latches (typically controllable from the operating cab) for engaging and disengaging latchable portions of the containers, to permit grasping, lifting, and moving of the containers by the lifting device.

By this invention, the lifting device carries an electrically operated location sensing device for sensing and signalling to the operator a proper positioning of the latches relative to the latchable portions of the containers, to permit such latching.

Preferably, a second actuator is provided to horizontally move the container lifting device, to provide it with two dimensions of motion. The lifting device may also be on wheels to provide a third horizontal dimension of motion for the moving of loads from one desired location to another.

The location sensing device described above may be of a variety of types for detecting a desired position, optionally without physical contact, although contacts with flexible sensing reeds, plungers, or the like for physical contact and for detecting a recess or projection comprising the latchable portion may be used. Preferably, non-contact sensors may include a magnetic sensor sensing an area of strong magnetism or absence thereof, an infrared or other type of retroreflective sensor, a photoelectric sensing system, or an ultrasonic type sensor.

The ultrasonic type sensor may comprise an ultrasonic emitter and an ultrasonic sensor, positioned to sense reflected ultrasonic signals from the emitter, and electronics to detect a change in character of the reflected and sensed ultrasonic signals indicative of the proper relative positioning of the latches and latchable portions.

For example, the latchable portions may comprise recesses, and the change in character of the reflected and sensed signals may comprise an increase in travel time between ultrasonic signal emission and ultrasonic signal sensing. If the ultrasonic sensor is properly located on the frame of the load transferring system, the system may be properly aligned with respect to recesses of a load when the ultrasonic signal received is of a proper characteristic.

Also or alternatively, least some of the latches may be carried on vertically extendible and retractable assemblies, which permits a stack of at least two containers to be carried by the latches and the container lifting device. Preferably, the vertically extendible and retractable assemblies are also horizontally extendible and retractable, so that the container lifting device may be retracted into a compact unit, and it may also be variably extended to lift single containers and stacks of containers of varying sizes.

Other latches may be positioned above the latches carried on the vertically extendible and retractable assemblies, the other latches being positioned to vertically engage latchable portions positioned on container top walls. Thus the device of this invention can be a "top pick" lifting device, and it can also engage containers from the side to lift them. Thus, the top container in a stack may be engaged by the latches which engage the container top walls, while lower containers in a stack may be engaged by other latches at their sidewalls, so that the entire stack can be lifted. The other, vertically-facing latches may also be carried on horizontally extendible and retractable portions of the assemblies in order to fit containers of varying size.

The lifting system of this invention also defines a transverse telescoping member which is capable of adjusting the horizontal width of the vertically extendible and retractable assemblies which carry latches for gripping a load. This enhances the adjustment capability for gripping containers of differing sizes, while also permitting compact stowage. For example, in one embodiment, the vertically extendible and retractable assemblies may be horizontally adjusted to permit engagement of loads having a width of 96 to 102 inches.

Specifically, the vertically extendible and retractable assemblies may comprise vertically extendable and retractable telescoping rods which carry latches adjacent their ends for engagement with containers positioned substantially below the bulk of the lifting and load transferring system of this invention. These vertical telescoping members may also be vertically moved as a whole to accommodate differing predetermined container heights, ranging for example from eight feet six inches to nine feet six inches. This can be accomplished by a plurality of lift cylinders to provide desired adjustability to the entire vertically extendible and retractable assembly so that the latches may engage containers of differing heights. Thus, the vertical telescoping rods may be fully extended, and still they may be vertically adjustable by the lift cylinders to engage the latchable portions of containers of different sizes.

Thus, a lifting and load transferring system is provided, the system being highly adjustable to accommodate differing types of load containers such as semi-trailers, containerized steel boxes, and the like. The loads may be engaged with the latches of the spreader or spreaders used for lifting, with the fine adjustment being performed at the control panel of the lifting and load transferring system, without the need for assistance because of the latch location sensing device described herein.

DESCRIPTION OF SPECIFIC EMBODIMENTS

Figure 1:
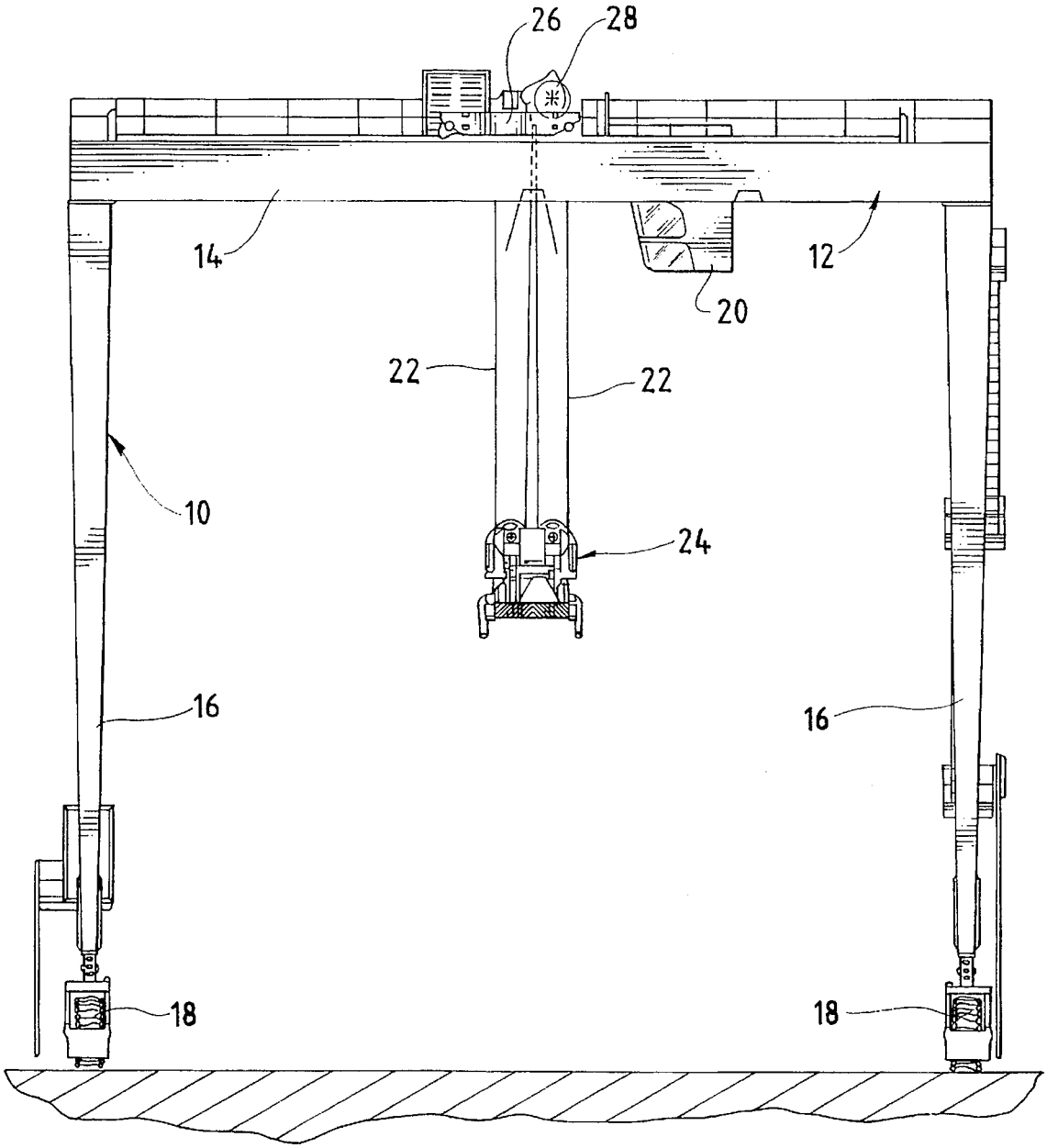
FIG. 1 is an elevational view of the load lifting and transferring system of this invention.
Figure 2:
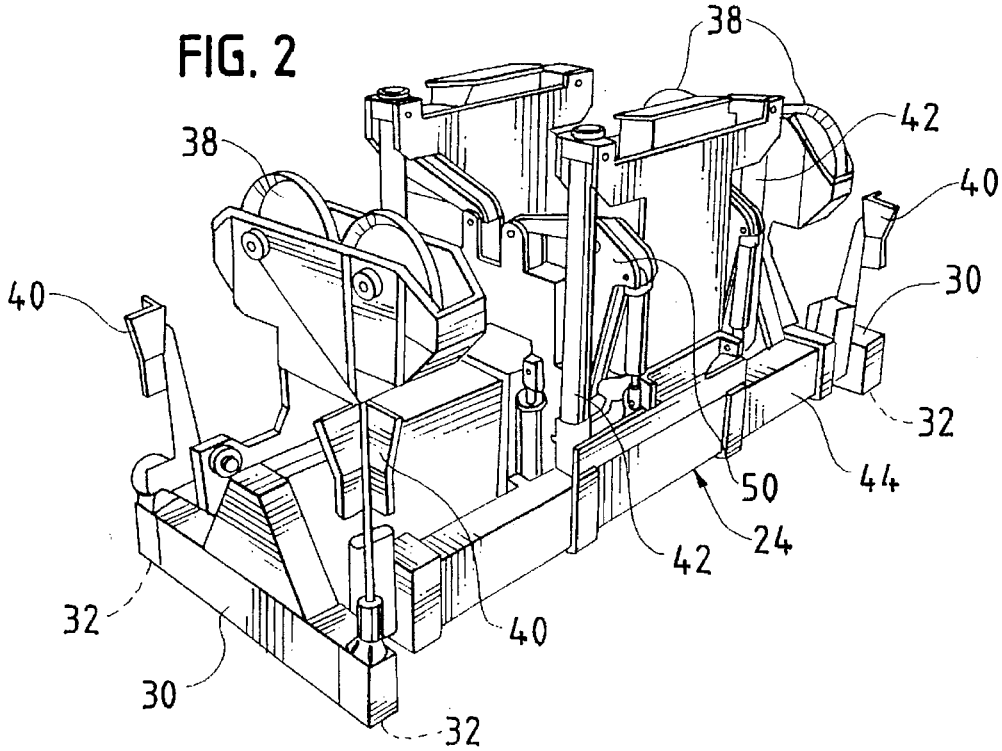
FIG. 2 is a detailed perspective view of the spreader of this invention, shown in the previous drawings, but with the spreader shown in its compact, closed-up, travelling position.
Figure 3:
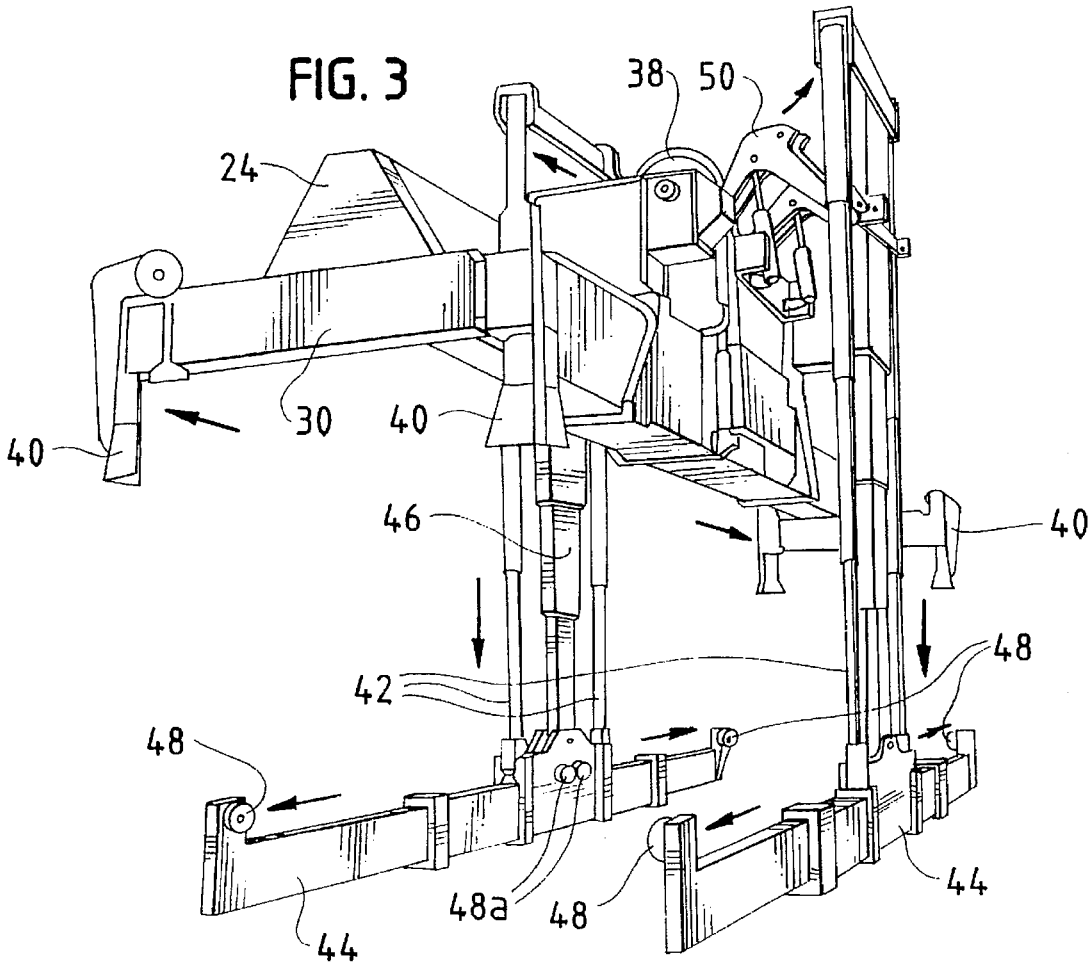
FIG. 3 is a perspective view of the spreader of FIG. 2, shown in an unfolded position for gripping a pair of stacked rectangular containers.

Referring to the drawings, FIGS. 1–3 show the load transferring and lifting system 10 of this invention which comprises a frame 12 having a platform 14 and legs 16, which are carried on road wheels 18 or rail wheels as desired. Platform 14 carries an operating cabin 20 and a generally conventional winding system for cable 22. Two pairs of cable loops are typically used to suspend the spreader 24 of this invention, which is used to grip containers or any other desired load as they are elevated and shifted.

By the term "cable", it is also intended to include the optional use of chains, rope, or the like in a similar, conventional manner for holding spreader 24. Basically, the lifting and load transferring system shown herein may be conventional except for the design of spreader 24.

Spreader 24 may be horizontally moved by the traversing mechanism 26 carried on elevated platform 14. Capstans 28 are powered to wind and unwind one end of each of cable loops 22 to raise or lower spreader 24 as may be desired. A power system may also be provided to propel the system on its wheels 18, so that the spreader can be moved through three dimensions to pick up and deposit loads in the desired positions.

Figure 4:
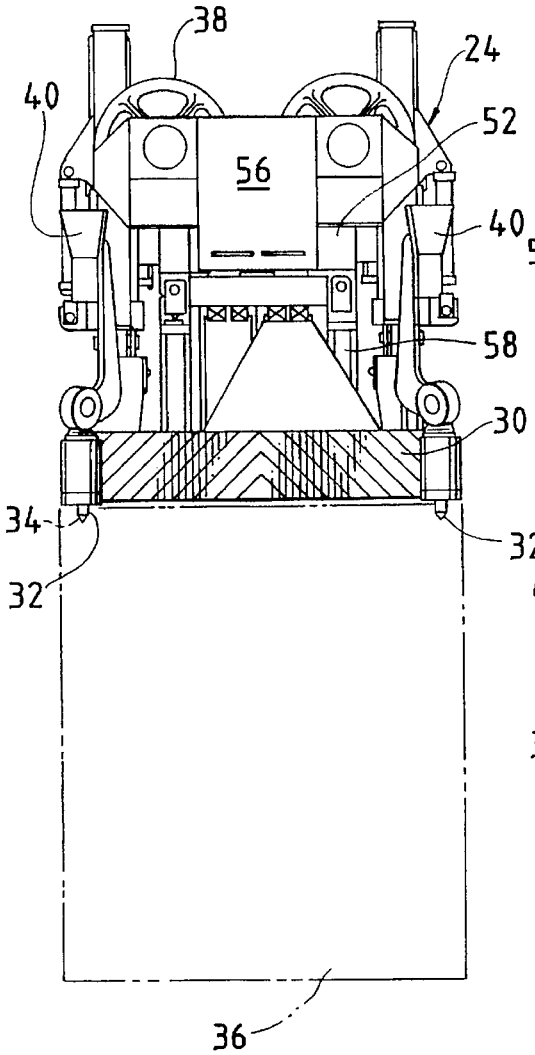
FIG. 4 is an end elevational view of the spreader of this invention in the configuration of FIG. 2.

Referring particularly to FIGS. 2 and 4, spreader 24 is shown in a folded-up travel position of minimum volume. Spreader 24 defines a pair of end bars 30 which carry at their respective ends latches 32 which point downwardly, so that the respective four latches at the respective ends of each of end bars 30 can engage latchable recesses 34 positioned in the top of a rectangular container load 36, one latching site being positioned at each corner thereof.

Thus, in the folded configuration of FIGS. 2 and 4, spreader 24 comprises a "top pick"spreader. Container 36 may be lifted by spreader 24 of system 10, horizontally transferred, and then deposited in another desired location. The width between legs 16 of system 10 as shown in FIG. 1 is typically enough to accommodate two or more railroad cars, trucks, or even barges in a manner similar to the disclosures of the last cited patent above, to greatly facilitate the shifting of loads between various vehicles.

Figure 5:
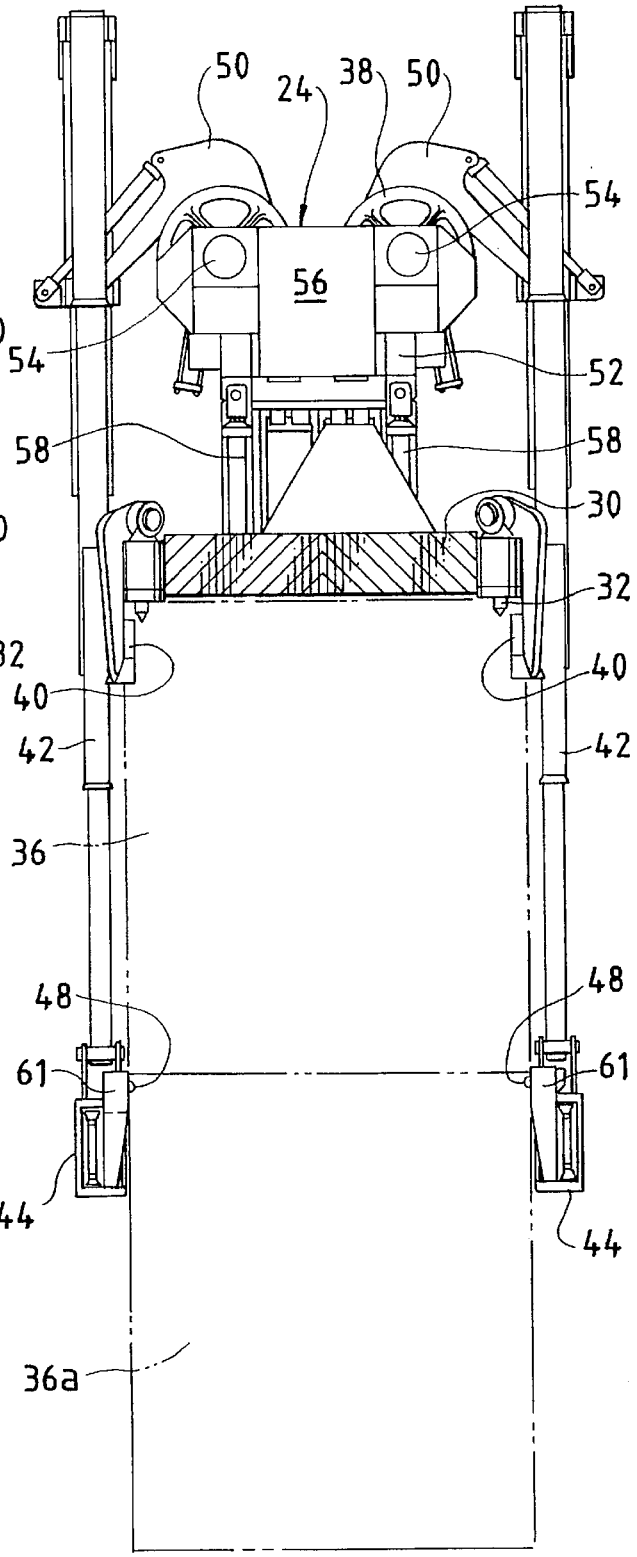
FIG. 5 is an end elevational view of the spreader as shown in FIG. 3.

Spreader 24 also carries the conventional cable wheels 38 for engagement with cable loops 22 to accomplish its load lifting purpose. Load stabilizers 40 are shown in FIGS. 2 and 4 in an upward, folded position out of the way for transport or when otherwise not needed. Their position of use is shown in FIGS. 3 and 5, when the load stabilizers 40 are pivoted and locked downwardly to engage and stabilize the corners of container 36, to facilitate centering and lateral support of the container as it is being carried by spreader 24.

Latching devices 32 may incorporate an electrically operated location sensing device as generally described below.

Spreader 24 also defines vertically extensible and retractable telescoping rods 42 which carry side bars 44, permitting them to be vertically depressed and raised between the respective positions shown in FIGS. 2 and 3. A central, vertical telescoping tube 46 of rectangular cross section is shown, positioned between a pair of circular telescoping tubes 42 for a desired load bearing capability. Also, telescoping tube 46 may comprise part of a hydraulic system for raising and lowering side bars 44.

Side bars 44 carry horizontally facing latches 48, which may also incorporate an electrically operated location sensing device as described in detail below. Telescoping tubes 42, 46 and side bars 44 may comprise individual assemblies which may be moved horizontally inwardly and outwardly by means of rotating arms 50. Transverse scroll member 52 (FIG. 5) provides added transverse telescoping to the legs 42 and arms 50, moving the respective assemblies horizontally outwardly and inwardly as the scroll member 52 rotates so that the system has a maximum width between side bars 44, in this embodiment, of 102 inches and a minimum width of 96 inches. Rotary arms 50 rotate about shafts 54.

Each side bar 44 carries added, central latches 48a to permit the sidebars to pick up one or a pair of half-length containers in end-to-end relationship, as an alternative to picking up one full-length container.

Also, arms 50, scroll member 52, and the frame 56 that carries them may be raised and lowered to accommodate container height settings, in this embodiment, of eight feet six inches to nine feet six inches. This is accomplished by four lift cylinders 58, which accordingly can move the respective telescoping rods and tubes 42, 46 upwardly and downwardly relative to end bars 30.

Thus, the respective latches 32, 48 can be moved vertically or horizontally with respect to each other, with the vertical height settings permitting adjustment so that a stack of containers 36, 36*a* may be simultaneously lifted and transferred to another position. It can be seen that stack 36*a* may be individually released in a new position by release of latches 48, followed by retraction of telescoping rods 42, and movement of container 36 to a different location, where latches 32 may release container 36.

Figure 6:
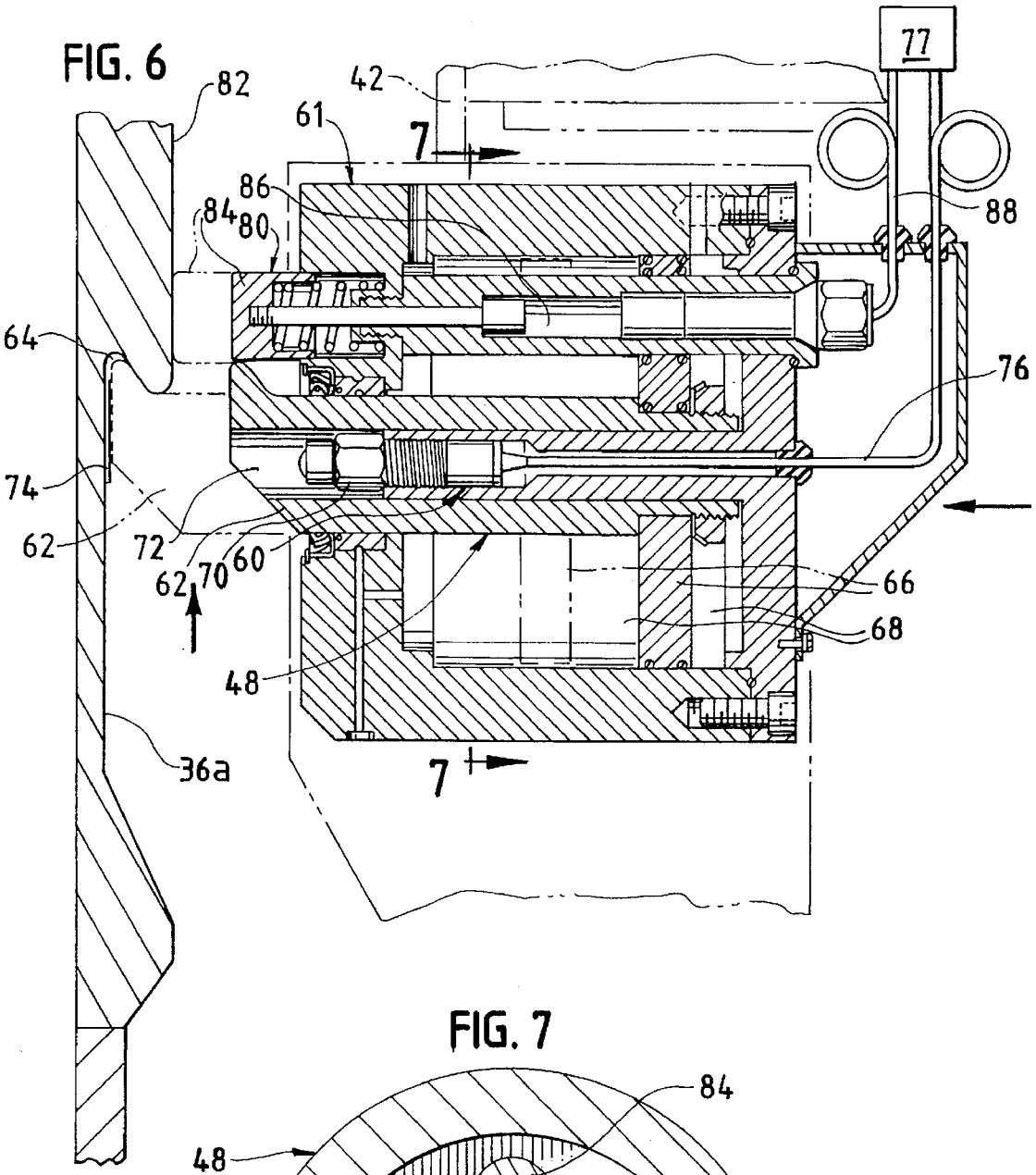
FIG. 6 is an enlarged, longitudinal sectional view of the location sensing device carried by the lifting and load transferring system of this invention.
Figure 7:
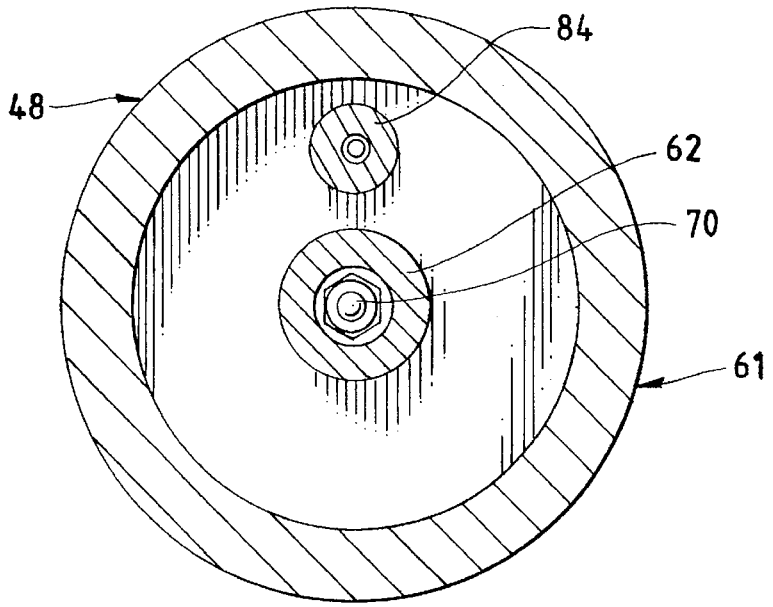
FIG. 7 is a sectional view taken along line 7—7 of FIG. 9.

Referring to FIGS. 6 and 7, in accordance with this invention an electrically operated, ultrasound based, location sensing device 60 is provided in a mounting 61, carried in conjunction with each lower latch 48 carried on extensible rods 42 (FIG. 5).

Latch assemblies 48 have a latching rod or pin 62 capable of hydraulic advancement into engagement with a latchable recess 64 of a container 36*a*, as shown in dotted lines. Movable latch pin 62 carries a sealed flange 66 which occupies a hydraulic cylinder 68. Conventional hydraulic lines communicate with cylinder 68 so that varying pressures in the cylinder either in front of flange 66 or behind it can cause pin 62 to advance or retract. An advanced position of flange 66 is also shown in phantom lines.

By this invention, a conventional infrared or ultrasonic sensor/receiver 70 is provided in an aperture 72 of pin 62. Ultrasonic or infrared signals are thus emitted forwardly from pin 62. The operator of the load transferring system, sitting in cab 20, brings spreader 24 into proximity of the desired load 36*a* to be lifted. The operator may not be able to see the precise position of latch pins 62 relative to apertures 64. However, when the position is proper so that aperture 64 and pin 62 are aligned, a change in character in the signals is sensed by the sensor portion of signal emitter/sensor 70, which signals may communicate by cable 76 to a microprocessor 77, and then to a readout in the control cabin. If the system is microwave based, an abrupt increase in the signal travel time can be sensed, indicating alignment of recess 64 and latch pin 62. If the signal is infrared, infrared reflective target 74 may cause an abrupt increase in the sensed signal, showing proper alignment of the latch, following which the latch is extended, to lock itself in recess 64 to permit lifting of container 36*a* when four of such latches 48 have engaged a container.

Engagement sensor 80 is positioned to press against the outer wall of container 36*a* as a safely check, providing assurance of proper latching. As a final stage of latching, latch pin 62 can be retracted to bring latch system 48 into engagement with the outer wall 82 of container 36*a* in tightly locked arrangement. As that takes place, spring mounted plunger 84 of engagement sensor 80 is pushed inwardly to its position shown in full lines from its phantom line position. This compression may be sensed by unit 86 in conventional manner, and a confirming signal can be sent through line 88 to microprocessor 77 as a positive indication of locking between latch 48 and recess 64.

Figure 8:
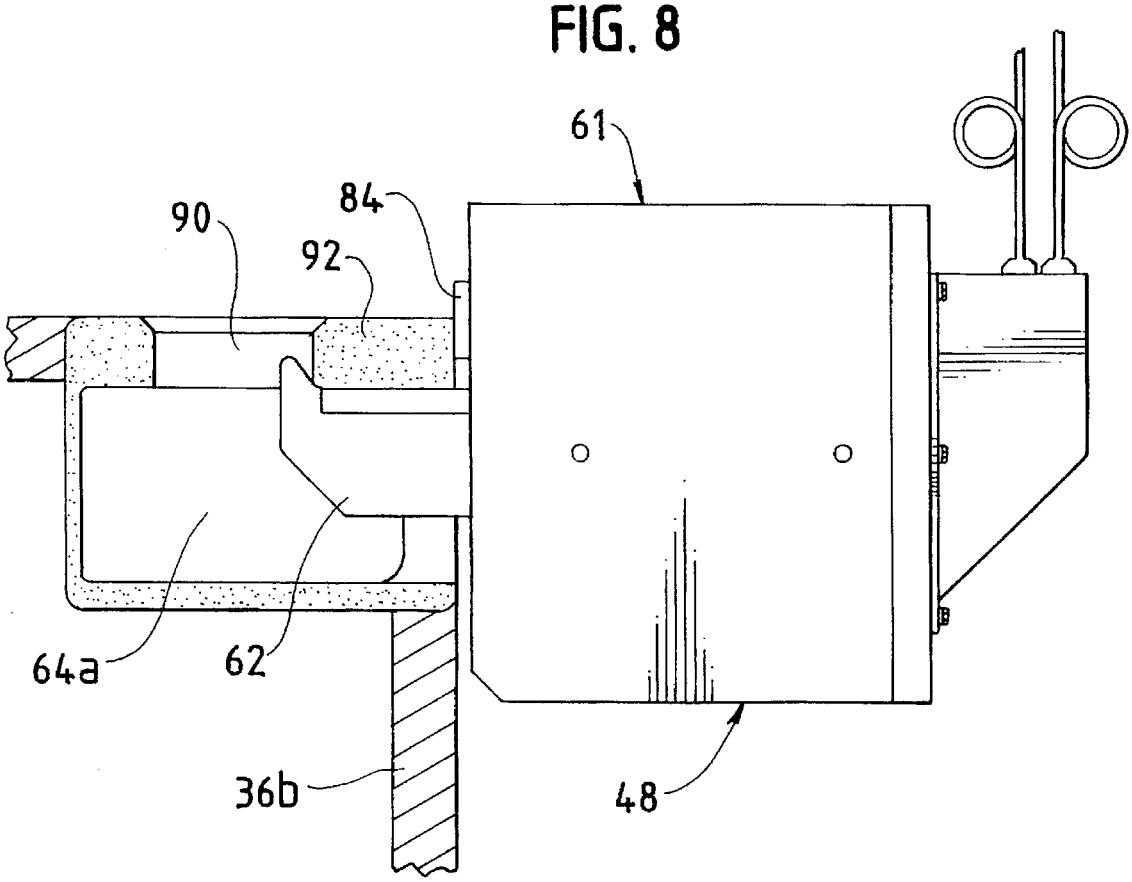
FIG. 8 is an enlarged, elevational view, taken partly in section, of an alternate design of latch members which may be carried by the lifting and load transferring system of this invention.

Referring to FIG. 8, the same or a similar latch assembly 48, carried in mounting or housing 61, as shown in the previous drawings can be used to connect to a latchable recess 64*a* defined in a wall of a container 36*b*, in which the container recess 64*a* is of a different design from that of the previous embodiment. Latching rod 62 is shown to be projecting into recess 64*a* and to hook into an upper aperture 90, defined by an ISO corner fitting 92. Position pin or plunger 84 is also shown engaging the corner of container 36*b* in a manner similar to that previously described. Location sensing device 60 is not shown in this embodiment, but may be present in a manner similar to that shown with the previous embodiment. Apart from differences shown, latch assembly 48 of FIG. 8 is identical in the way it is carried and utilized, as described with respect to the previous embodiments with respect to latch assemblies 48, 48*a* shown therein.

Thus an adjustable spreader is provided, being capable of picking up and moving single, rectangular containers, including trailers, truck bodies and similar structures, in which the various containers may be of various sizes. Stacks of containers may be elevated and moved as well as single containers. Also, a system is provided for aligning latches on the spreader with latchable sites on the various containers, even though the operator cannot directly see the positioning of the latches with the latchable sites, so that the entire operation may be reliably and safely performed by an operator in a cab mounted on the lifting system.

The above has been offered for illustrative purposes only, and is not intended to limit the scope of the invention of this application, which is as defined in the claims below.

That which is claimed:

1. A system for lifting and transferring load containers which comprises a frame; a container lifting device; a cable attached to said frame and lifting device; and a first actuator for raising and lowering said lifting device; said lifting device having a plurality of remotely controllable latches for engaging and disengaging latchable portions of said containers, to permit grasping and lifting of containers by said lifting device, said latches each comprising a pin having an axis, and a hydraulic system for advancing and retracting said pin along said axis into engaged and disengaged relation with said latchable portions; said pin having an axial bore carrying an electrically operated, signal emission-type location sensing device for sensing and signalling to the operator a proper location of said latches relative to said latchable portions to permit said latching.

2. The system of claim 1 in which a second actuator is provided to horizontally move said container lifting device.

3. The system of claim 1 in which said location sensing device comprises an ultrasonic emitter, an ultrasonic sensor positioned to sense reflected ultrasonic signals from the emitter, and electronics to detect a change in character of the reflected ultrasonic signals indicative of the proper relative positioning of said latches and latchable portions.

4. The system of claim 3 in which said latchable portions comprise recesses, and said change in character of the reflected signals comprises an increase in travel time between signal emission and signal sensing.

5. The system of claim 1 in which said location sensing device comprises a photoelectric sensing system.

6. The system of claim 1 in which at least some of said latches are carried on vertically extendable and retractable assemblies, whereby a stack of at least two containers may be carried by said latches and container lifting device.

7. The system of claim 6 in which at least eight of said latches are carried on said vertically and extendible and retractable assemblies, to permit engagement and lifting of two side-by-side containers.

8. The system of claim 6 in which said vertically extendable and retractable assemblies are also horizontally extendable and retractable, whereby the container lifting device may be retracted into a compact unit, and the container lifting device may be variably extended to lift single containers and stacks of containers of varying sizes.

9. The system of claim 8 in which other latches are positioned above said latches carried on the vertically extendable and retractable assemblies, said other latches being positioned to engage latchable portions positioned on container top walls.

10. The system of claim 8 in which said horizontally extendible and retractable assemblies are operatively connected to a transverse telescoping member which comprises an actuator for horizontally extending and retracting said vertically extendible and retractable assemblies, to provide horizontally movable adjustment to said vertically extendible and retractable assemblies.

11. The system of claim 8 in which said vertically extendible and retractable assemblies comprise a plurality of vertically extendible and retractable telescoping rods and a hydraulic system for extending and retracting them.

12. The system of claim 11 in which said vertically extending and retractable telescoping rods are raisable and lowerable as a unit by a plurality of hydraulic lift cylinders, to provide adjustability to the vertical position of said telescoping members in their fully extended position.

13. A system for lifting and transferring load containers which comprises a frame; a container lifting device; a cable attached to said frame and lifting device; and a first actuator for raising and lowering said lifting device; said lifting device having a plurality of remotely controllable first latches for engaging and disengaging latchable portions of said containers, to permit grasping and lifting of a container by said lifting device, at least eight of said first latches being carried on vertically extendible and retractable assemblies to permit engagement and lifting of two side-by-side containers, a plurality of second latches being positioned above said first latches carried on the vertically extendible and retractable assemblies, said second latches being positioned to engage latchable portions positioned on container top walls, said first latches being carried on horizontally extendible and retractable portions of said assemblies, whereby a stack of at least two containers may be carried by said first and second latches and container lifting device; said first latches each comprising a pin having an axis, and a hydraulic system for advancing and retracting said pin along said axis into engaged and disengaged relation with said latchable portions; said pin having an axial bore carrying an electrically operated, signal emission-type location sensing device for sensing and signalling to the operator a proper location of said latches relative to said latchable portions to permit said latching.

14. The system of claim 13 in which said location sensing device comprises an ultrasonic emitter, an ultrasonic sensor positioned to sense reflected ultrasonic signals from the emitter, and electronics to detect a change in character of the reflected ultrasonic signals indicative of the proper relative positioning of said latches and latchable portions.

15. The system of claim 13 in which said location sensing device comprises a photoelectric sensing system.

16. The system of claim 13 in which the container lifting device may be retracted into a compact unit, and the container lifting device may be variably extended to lift single containers and stacks of containers of varying sizes.

17. The system of claim 16 in which said vertically extendible and retractable assemblies comprise a plurality of vertically extendible and retractable telescoping rods and a hydraulic system for extending and retracting them.

18. The system of claim 17 in which said horizontally extendible and retractable portions are operatively connected to a transverse telescoping member which comprises an actuator for horizontally extending and retracting said vertically extendible and retractable assemblies, to provide horizontally movable adjustment to said vertically extendible and retractable assemblies.

* * * * *